US010159615B1

(12) United States Patent
Brown et al.

(10) Patent No.: US 10,159,615 B1
(45) Date of Patent: Dec. 25, 2018

(54) GRIP FOR PERSONAL LIFT AID

(71) Applicant: Global Franchise Consultants, Inc., Fort Mill, SC (US)

(72) Inventors: Donald Arthur Brown, Fort Mill, SC (US); Shirley Jean Brown, Fort Mill, SC (US)

(73) Assignee: Global Franchise Consultants, Inc.

( * ) Notice: Subject to any disclaimer, the term of this patent is extended or adjusted under 35 U.S.C. 154(b) by 0 days.

(21) Appl. No.: 15/966,099

(22) Filed: Apr. 30, 2018

(51) Int. Cl.

| | |
|---|---|
| ***A61G 7/10*** | (2006.01) |
| ***A61G 7/053*** | (2006.01) |
| ***A61G 5/14*** | (2006.01) |
| *A61H 3/00* | (2006.01) |

(52) U.S. Cl.
CPC ..... *A61G 7/10* (2013.01); *A61G 5/14* (2013.01); *A61G 7/0533* (2013.01); *A61G 7/1038* (2013.01); *A61H 2003/001* (2013.01)

(58) Field of Classification Search
CPC ..... A61H 2003/001; A61H 2003/007; A61H 3/0288; A61G 5/14; A61G 7/10
USPC ..... 74/543; 16/110.1, 430
See application file for complete search history.

(56) References Cited

U.S. PATENT DOCUMENTS

| | | | | |
|---|---|---|---|---|
| 2,757,388 | A | 8/1956 | Chisholm | |
| 4,135,536 | A | 1/1979 | Willis | |
| 4,493,334 | A | 1/1985 | Semanchik et al. | |
| 4,501,957 | A | 2/1985 | Perlman et al. | |
| 4,899,771 | A | 2/1990 | Wilkinson | |
| 5,090,072 | A | 2/1992 | Gray | |
| 5,093,944 | A | 3/1992 | Winston, Sr. | |
| 5,189,741 | A | 3/1993 | Beardmore | |
| 5,295,498 | A * | 3/1994 | Van Meter | A61G 5/14 135/65 |
| 5,307,828 | A | 5/1994 | Gardner et al. | |
| 5,327,592 | A | 7/1994 | Stump | |
| 5,507,044 | A | 4/1996 | Williamson et al. | |
| 5,586,352 | A | 12/1996 | O'Brien et al. | |
| 5,802,633 | A | 9/1998 | Capaldi | |

(Continued)

FOREIGN PATENT DOCUMENTS

| | | |
|---|---|---|
| GB | 874 724 | 8/1961 |

OTHER PUBLICATIONS

Gimme a Lift, "Nurse Lift Instructions," Brochure, Dec. 26, 2017.

*Primary Examiner* — David R Dunn
*Assistant Examiner* — Danielle Jackson
(74) *Attorney, Agent, or Firm* — Emerson Thomson Bennett LLC; Daniel A. Thomson

(57) ABSTRACT

A lifting device is herein disclosed including an elongated member of substantially rigid material having a first end and a second end, wherein the elongated member is sufficiently resilient such that the elongated member may bend up to five degrees and still return to a vertical position, at least one grip circumferentially attached to the elongated member, wherein the at least one grip is friction fit onto the elongated member, wherein the at least one grip has a first end, a second end, and a central portion, patient grip safety ring located circumferentially about the first end of the central portion of the at least one grip, wherein the ring has an exterior lip that has a radius between 10 degrees and 45 degrees with respect to a perpendicular axis of the elongated member, and an anchor pad pivotably attached to the second end of the elongated member.

16 Claims, 6 Drawing Sheets

(56) References Cited

U.S. PATENT DOCUMENTS

| | | | | |
|---|---|---|---|---|
| 6,044,507 | A | 4/2000 | Smith | |
| 6,138,699 | A | 10/2000 | Su | |
| 6,276,007 | B1 | 8/2001 | Brown | |
| 6,615,432 | B1 | 9/2003 | Blaylock | |
| 6,834,660 | B1 * | 12/2004 | Van Wart, Jr. | A61H 3/02 135/72 |
| 6,961,967 | B1 | 11/2005 | Brown | |
| 7,222,633 | B1 * | 5/2007 | Werner, III | A45B 9/02 135/65 |
| 7,363,931 | B2 * | 4/2008 | Weaver | A61G 7/1038 135/66 |
| 8,166,987 | B2 * | 5/2012 | Weaver | A61G 5/14 135/67 |
| 8,215,204 | B2 * | 7/2012 | Segato | B62K 21/26 16/430 |
| 9,138,369 | B1 * | 9/2015 | Chadwell | A61H 3/00 |
| 2002/0010961 | A1 * | 1/2002 | Brown | A61G 7/053 5/81.1 RP |
| 2004/0250845 | A1 * | 12/2004 | Rudin | A45B 7/005 135/77 |
| 2012/0322632 | A1 * | 12/2012 | Kezer | A45B 9/00 482/121 |

* cited by examiner

FIG. 10A
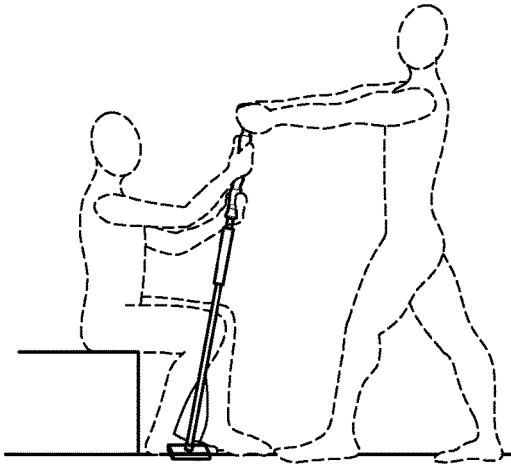
FIG. 10B
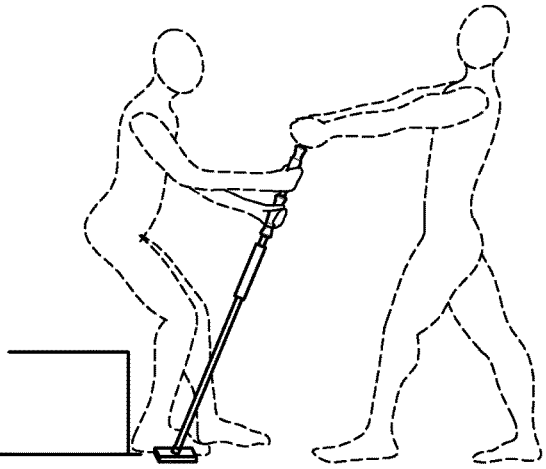
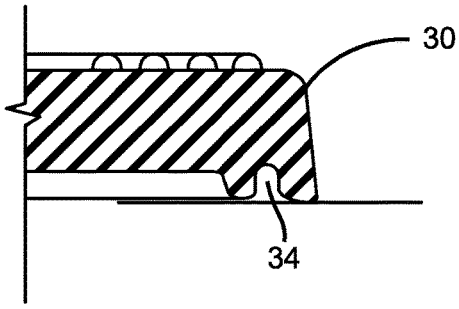
FIG. 10C $$\text{Mechanical Advantage (Ideal)} = \frac{\text{Effort Distance (E.D.)}}{\text{Resistance Dist. (R.D.)}}$$

$$\text{Mechanical Advantage (Ideal)} = \frac{\text{Resistance}}{\text{Effort}}$$

$$\frac{\text{E.D.}}{\text{R.D.}} = \frac{\text{R}}{\text{E}} \quad \begin{matrix}\text{(patient)}\\ \text{(nurse)}\end{matrix}$$

$$E = R\,\frac{R.D.}{E.D.}$$

GRIP FOR PERSONAL LIFT AID

BACKGROUND

A. Field

The present teachings generally relate to methods and apparatuses for lift aids, and more particularly to an improved grip for a personal lift aid.

B. Background

Prior to U.S. Pat. Nos. 6,961,967 and 6,276,007, the use of patient lifts, and more specifically, portable patient lifts heretofore devised and utilized are known to comprise of complicated structural configurations, not withstanding the myriad of designs encompassed by the crowded field that have been developed for the fulfillment of countless objectives and requirements.

Prior to U.S. Pat. Nos. 6,961,967 and 6,276,007, various types of complex mechanical and electro-mechanical patient lift devices have been around for years. However, caregivers and other individuals are reluctant to use them because they are large, heavy, bulky, complicated, and time consuming to setup and use. And the devices have been found to be costly, present a storage problem, and require the assistance of others to operate.

Prior to U.S. Pat. Nos. 6,961,967 and 6,276,007, the devices are also limited in that they only pertain to the non-ambulatory, invalid, or bed-ridden patient. Furthermore, the devices have a limited use of only lifting and lowering said patients. The devices have short-range transport capability, and, consequently, are substantially restricted to indoor use. As a result, individuals cannot take them to work, to a restaurant, to attend a sporting event, or other daily outside activities.

Additionally, the devices are not designed for an individual to use as a rehabilitation aid that may help them regain a mobile lifestyle. While these devices fulfill their respective particular objectives and requirements, the aforementioned do not disclose a personal lift aid that may be used for the two different modes of operation that are as follows: Unassisted (where the patient and/or individual can use it by themselves) or Assisted (with the help of a caregiver or spouse).

Prior to U.S. Pat. Nos. 6,961,967 and 6,276,007, also not disclosed is an unassisted portable aid to descend and ascend stairs, which is manually operated and not powered by electric or hydraulics. Furthermore, there is no known device without wheels whose base support was anchored to the ground or floor by means of stepping on it. The devices that were discovered required fasteners such as bolts or screws to attach the devices to the ceiling or floor, thus marring the surfaces.

Hospitals today want patients to get out of bed as soon as possible to begin rehabilitation, thus reducing the likelihood of complications occurring as a result of being bed-ridden and fear of moving about. It is also important for the patients to start using the affected muscles, that were traumatized as a result of surgery, and to move about as soon as possible so that blood circulation returns to normal. The personal lift aid helps the individual out of a bed or chair and also supports them once they are up and about, thereby aiding in their rehabilitation. Hospitals are a safe place, but can even be safer for individuals if they are given the opportunity to use the personal lift aid.

II. Summary

In accordance with one aspect of the present teachings, a lifting device includes an elongated member of substantially rigid material having a first end and a second end, wherein the elongated member is sufficiently resilient such that the elongated member may bend up to five degrees and still return to a vertical position, an interior reinforcing member located within the elongated member, a clear, anti-microbial coating covering the surface of the elongated member, at least one grip circumferentially attached to the elongated member, wherein the at least one grip is friction fit onto the elongated member, wherein the at least one grip has a first end, a second end, and a central portion, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly, wherein the grip has a non-smooth surface, patient grip safety ring located circumferentially about the first end of the central portion of the at least one grip, wherein the ring has an exterior lip that has a radius between 10 degrees and 45 degrees with respect to a perpendicular axis of the elongated member, a handle fixedly attached to the first end of the elongated member, and an anchor pad pivotably attached to the second end of the elongated member, wherein the anchor pad has a pivotable neck extending upwardly from the anchor pad, wherein the anchor pad has at least one beveled side angled downwardly away from the pivotable neck, wherein the anchor pad has a bottom side, wherein the bottom side of the anchor pad has multiple indentations. In addition, the bottom has an outer rectangular ring that is beveled on the inside of the ring, which creates a light suction on vinyl, linoleum, hardwood, ceramic, and hard surfaced floors.

In accordance with one aspect of the present teachings, a lifting device including an elongated member of substantially rigid material having a first end and a second end, wherein the elongated member is sufficiently resilient such that the elongated member may bend up to five degrees and still return to a vertical position, at least one grip circumferentially attached to the elongated member, wherein the at least one grip is friction fit onto the elongated member, wherein the at least one grip has a first end, a second end, and a central portion, patient grip safety ring located circumferentially about the first end of the central portion of the at least one grip, wherein the ring has an exterior lip that has a radius between 10 degrees and 45 degrees with respect to a perpendicular axis of the elongated member, and an anchor pad pivotably attached to the second end of the elongated member.

In accordance with one aspect of the present teachings, wherein the device further comprises a handle fixedly attached to the first end of the elongated member.

In accordance with one aspect of the present teachings, wherein the device further comprises an interior reinforcing member located within the elongated member.

In accordance with one aspect of the present teachings, wherein the device further comprises a clear, anti-microbial coating covering the surface of the elongated member.

In accordance with one aspect of the present teachings, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly.

In accordance with one aspect of the present teachings, wherein the grip has a non-smooth surface.

In accordance with one aspect of the present teachings, wherein the anchor pad has a pivotable neck extending upwardly from the anchor pad, and is capable of lifting up to 400 pounds (880 kg) with only 40 pounds (88 kg) of force. The device has both horizontal and vertical mechanical leverage, and can have up to a 10:1 mechanical leverage.

In accordance with one aspect of the present teachings, wherein the anchor pad has at least one beveled side angled downwardly away from the pivotable neck.

In accordance with one aspect of the present teachings, wherein the anchor pad has a bottom side, wherein the bottom side of the anchor pad multiple indentations.

In accordance with one aspect of the present teachings, wherein the anti-microbial coating is silver infused.

In accordance with one aspect of the present teachings, wherein the at least one grip and the handle are non-porous.

In accordance with one aspect of the present teachings, wherein the anchor pad is quadrilateral, and each side of the quadrilateral has a beveled edge on both the inner side and outside.

In accordance with one aspect of the present teachings, wherein the beveled edge is angled at between 30 degrees and 60 degrees.

In accordance with one aspect of the present teachings, wherein the bottom of the anchor pad has suction devices.

Other benefits and advantages will become apparent to those skilled in the art to which it pertains upon reading and understanding of the following detailed specification.

III. BRIEF DESCRIPTION OF THE DRAWINGS

The present teachings are described hereinafter with reference to the accompanying drawings.

Figure 10:
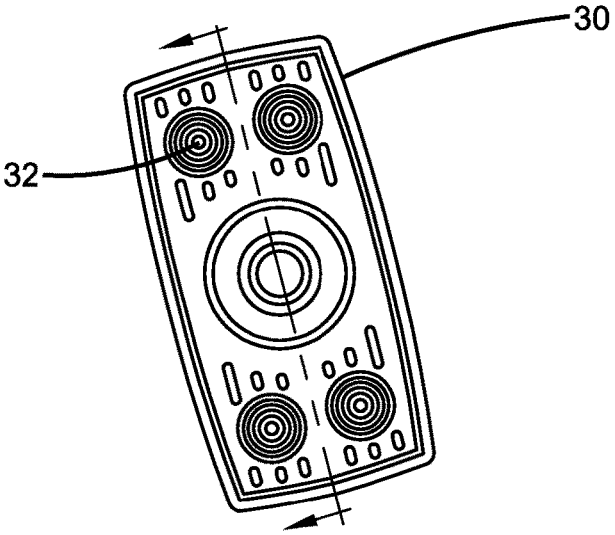
FIG. 10 shows a bottom view of the anchor pad.
Figure 11A:
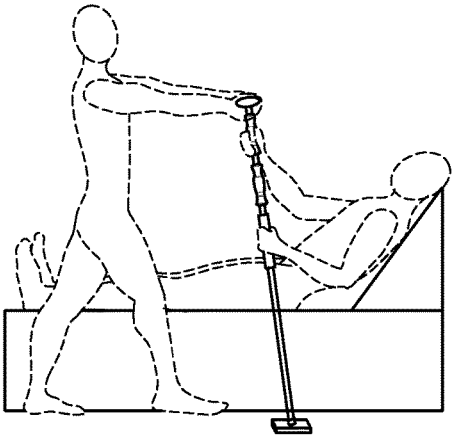
Figure 11B:
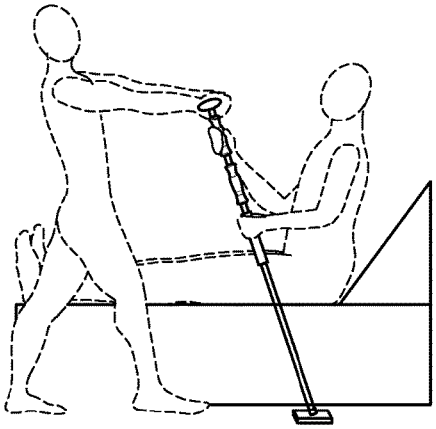
Figure 12A:
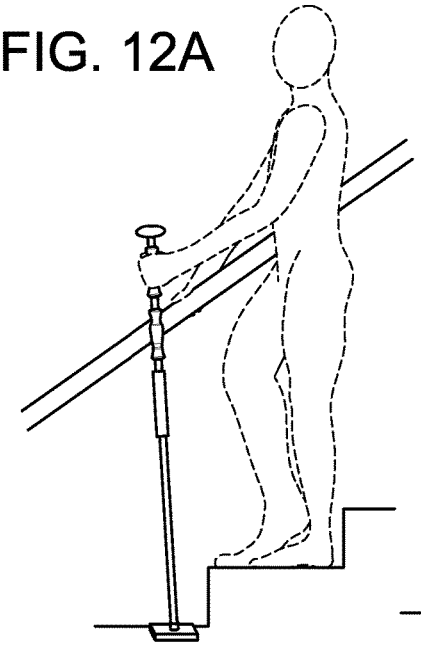
Figure 12B:
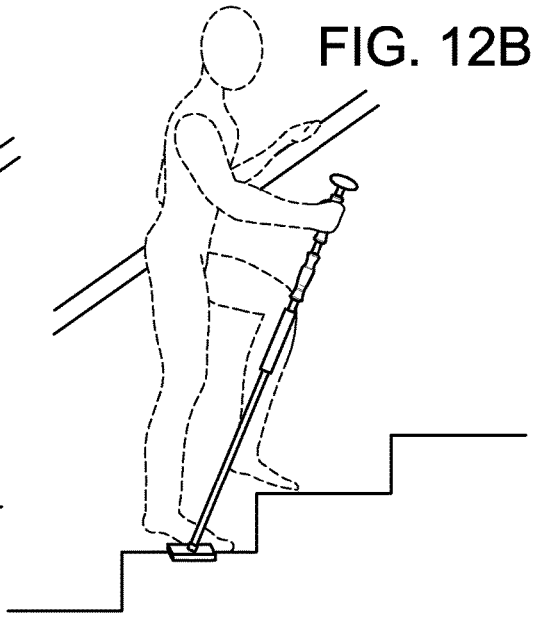

FIG. 10*a* shows an individual being lifted with the assistance of another;

FIG. 10*b* shows an individual being lifted with the assistance of another;

FIG. 10*c* shows an exploded cutaway side view of the anchor pad;

FIG. 11*a* shows an individual being lifted with the assistance of another;

FIG. 11*b* shows an individual being lifted with the assistance of another;

FIG. 12*a* shows an individual using the device to walk up stairs;

FIG. 12*b* shows an individual using the device to walk down stairs; and

Figure 13:
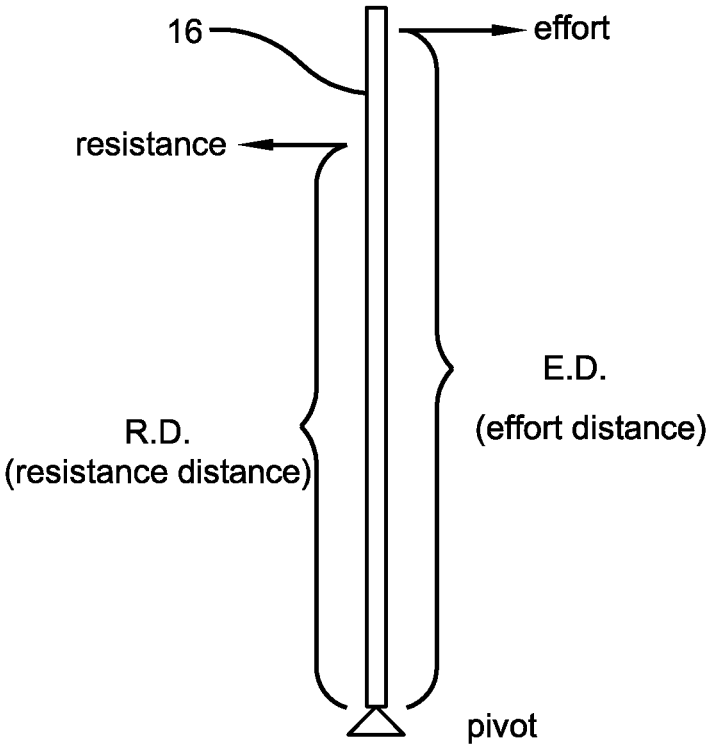

FIG. 13 shows mechanical advantage using leverage.

IV. DETAILED DESCRIPTION

In reference to the FIGS. 1, 2, and 7-10 the novel new personal lift aid embodying the principles and concepts of the present teachings and generally designated by the reference number 10 will be described. More specifically, the device 10 comprises of an elongated member 16, such as a stanchion 16, made of material that will allow the elongated member 16 to bow when used to lift an individual, but then return to its original straight shape. The elongated member 16 can be over fifty inches in length with about a 0.8 inch diameter and reinforced internally for added strength and durability. FIG. 2 shows one optional shape for the internal reinforcement. The stanchion 16 acts as a lever to enable lifting, lowering, and transferring of individuals. In one aspect, the stanchion 16 has an outer diameter (OD) of approximately 0.8 inches and a wall thickness of about 0.9 inches. In one aspect the stanchion 16 is about fifty inches in length. The longer, thicker, and wider stanchion 16 allows for more robust use of the device 10, and allows use on heavier patients. However, the stanchion 16 can be any length chosen using sound engineering judgment. For example, the length of the stanchion 16 can be reduced so that a child can easily use the personal lift aid. Further, the stanchion 16 can be adjustable, so that the length of the stanchion 16 can be adjusted to the specific needs of the individual user. The stanchion 16 can have a silver infused anti-microbial coating along the entire surface of the stanchion 16 in order to prevent the spread of illnesses and infections. In one aspect, the coating can be Silver San® from PPG, an anti-microbial protected powder coating treated with silver ionic technology. The anti-microbial coating can be applied as a clear coat, such that it does not affect the use of the device 10. In one aspect, the stanchion 16 can also be made of copper. A handle 11 made of a semi-hard material with a durometer reading of between 60A-95A hardness and secured to the stanchion 16 at its upper end. The handle 11 can be approximately three and one-half inches wide by one and three quarter inches high. The upper end of the stanchion 16 is inserted into the handle 11 with a tight frictional fit thereof for permitting manual maneuverability by a caregiver. The handle 11 can be used with two hands, one on top of the other, for exerting an effort to pull the stanchion 16. It is to be understood that the caregiver could use only one hand, as well as using bent arms. In one aspect, the handle 11 is secured to the stanchion 16 via friction. However, any securing means chosen using sound engineering judgment, such as a thread type attachment, screws, nuts and bolts, adhesives, etc., may be used to secure the handle 11 to the stanchion 16. Further, the stanchion 16 and the handle 11 can be made of a single piece of material.

Figure 1:
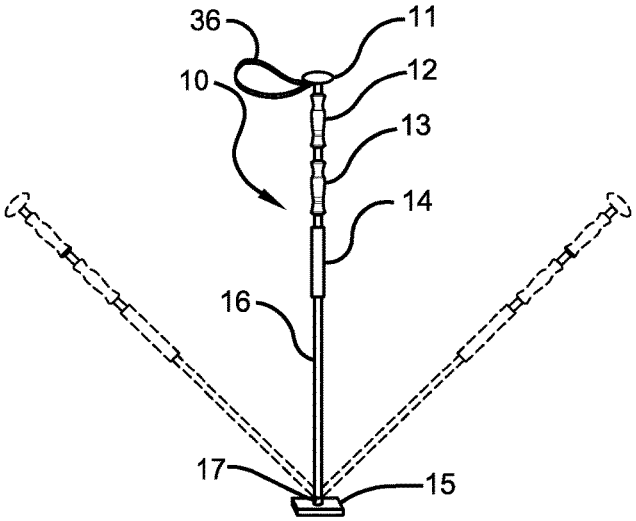
FIG. 1 shows various view of a lift device.
Figure 2:
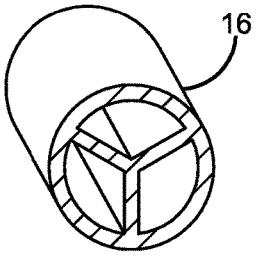
FIG. 2 shows an exploded cross-sectional view of the device.
Figure 3:
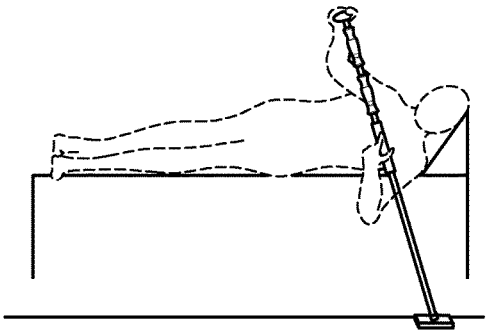
FIG. 3 shows a front view of a supine individual with the device.
Figure 4:
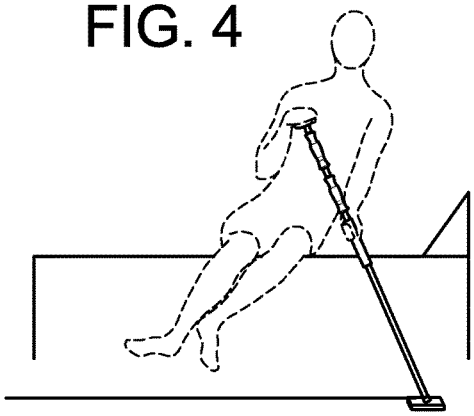
FIG. 4 shows a front view of a supine individual lifting themselves with the device.
Figure 5:
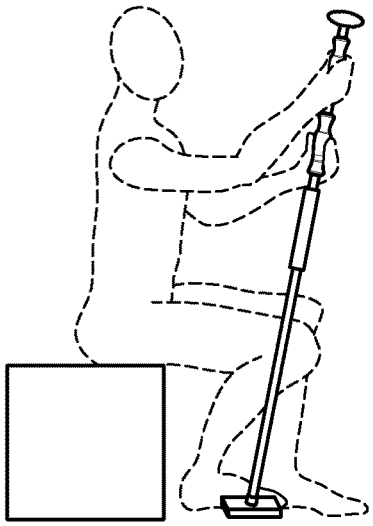
FIG. 5 shows a side view of a sitting individual with the device.
Figure 6:
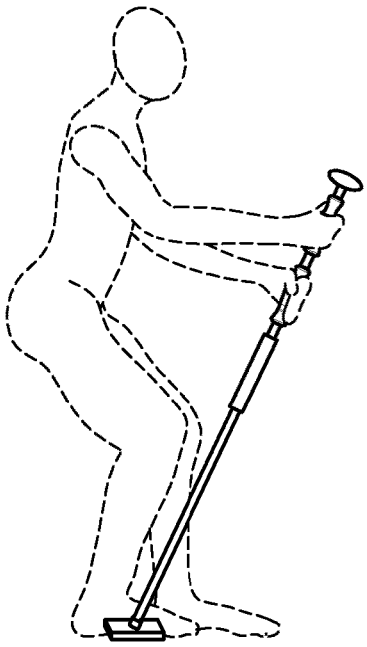
FIG. 6 shows a side view of a sitting individual lifting themselves to the standing position with the device.

With continued reference to FIG. 1, three hand grips 12, 13, and 14, are manually manipulated by the individual during use thereof to achieve certain methods of operation, further described in the operation section. Hand grips 12 and 13 can be about five inches long by about one and one-half inches in diameter. Hand grip 14 can be between about six to nine inches long and also between about one and about one and one-half inches in diameter. The three hand grips 12, 13, and 14, all have a hollow, internal, uniform cavity in their center running lengthwise, with about a three-quarter inch diameter. The hand grips 12, 13, and 14, can be made of a soft touch, closed cell material that is easy to clean, durable and non-absorbent, and have an outer surface that is grippable, which in one aspect can be platinum silicone. The hand grips 12, 13, and 14, inside cavity surface is capable, when grasped firmly, of tacking-and-holding the stanchion 16 to prevent slipping. They are also capable of being adjusted to an individual's height. In one aspect, the hand grips 12, 13, and 14 are friction fit and UV protected. In another aspect, the platinum silicone material for grips 12, 13 is made in a clean room and is non-porous. In one aspect, the grips 12, 13 start with a radius taper from the top of the grip 12, 13 downward about ¼", which enables ease of cleaning. This radius also is duplicated on the bottom side of the grip 12, 13 for cleaning.

With continuing reference to FIGS. 1, 2 and 7-10*c*, a ground engaging (step-on) anchor pad 15 and its pivotable neck 17 can be a one piece unit made of semi-hard material with a durometer reading of between 50A-75A hardness and secured to the lower end of the stanchion 16. The anchor pad 15 has a flat rectangular design about two and one-half inches wide by about five inches in length with four corners and a perimeter edge that has a flat surface perpendicular to the floor. The anchor pad 15 can have beveled edges 30 that are angled toward the floor in order to provide better grip on a ground surface, and has groove 34. The top of the anchor pad 15 can be flat to enable an individual to stand firmly and substantially with the ball of one or both feet on the anchor pad 15. The bottom of the anchor pad 15 is also flat by design enabling it to have maximum surface contact for optimum anchoring to the ground or floor when being stepped on, thus not allowing it to roll or move. The bottom of the anchor pad 15 has suction rings 32 for gripping hard surfaced ground and floors by applying downward pressure on the stanchion 16 with the use of any combination of the hand grips 12, 13, or 14. The suction rings 32 can have a circular shape to enable the stanchion 16 to be used at various angles, thus preventing movement and/or slipping of the stanchion's 16 base. The perimeter beveled edge 30 creates temporary suction when downward force is applied.

Figure 7:
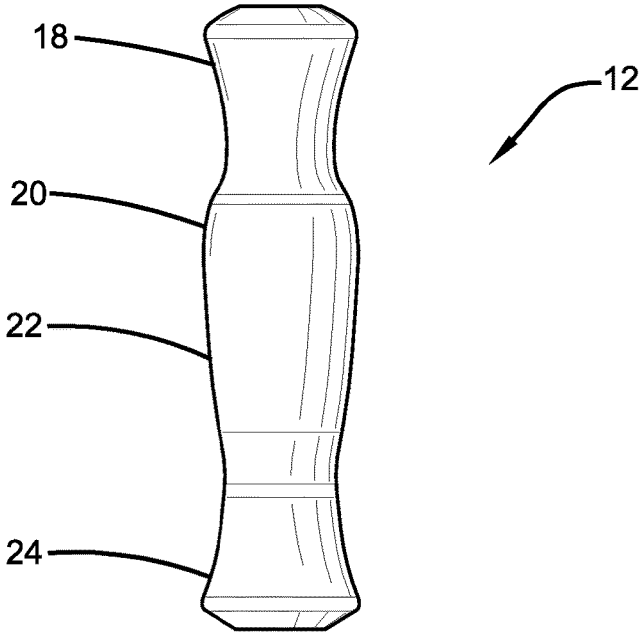
FIG. 7 shows a front view of a grip.
Figure 8:
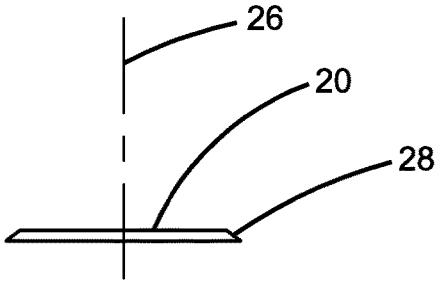
FIG. 8 shows a front view of the indicator ring.
Figure 9:
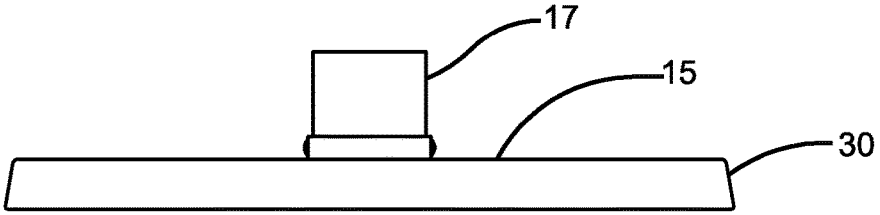
FIG. 9 shows a front view of the anchor pad.

With reference now to FIGS. 7 and 8, the grip 12 has a first end 18, a central portion 22, and a second end 24, wherein the central portion 22 has a first end and a second end, wherein the circumference of the first end 18, the second end 24, and the central portion 22 are substantially equal, wherein between the first end 18 of the grip 12 and the first end of the central portion 22, the grip 12 tapers inwardly, wherein between the second end 24 of the grip 12 and the second end of the central portion 22, the grip 12 tapers inwardly, wherein the grip 12 has a non-smooth surface. At the first end of the central portion 22 is an indicator ring (patient grip safety ring) 20 located circumferentially about the first end of the central portion 22. The ring 20 has an exterior lip 28 that has a radius of between 10 degrees and 45 degrees with respect to a perpendicular axis 26 of the elongated member 16. The ring 20 can be used as an indicator as to whether or not an individual is strong enough to hold on to the device 10. If the individual's hand slips off the lip 28, then a strap 36 can be used to aid in lifting. If a patient has weak arms, their thumb and index finger will slip over the ring 20, alerting the nurse who is able to see the slippage. The nurse can try again, and if the slippage is noticed they need to use an adjustable back strap 36 that is used in two modes of operation. It may be used as a gate belt that goes around the patient's back, sides, and front stomach area. It may also be used only around the patient's back and side area, but not the ventral front area because of certain surgery. In one aspect of the present teaching, the metal used on the strap 36 is non-magnetic, so that it can be used in radiology and Mill procedures. In addition, the stanchion 16 is also non-magnetic. The lip 28 has a 20 degree radius. The lower angle aids in preventing a build-up of dust on the lip 28. The grip 12 has a textured surface in order to create additional friction so that a user's hand is less likely to slip.

With reference to FIGS. 3-6, 10*a*, 10*b*, 11*a*, 11*b*, 12*a*, 12*b*, and 13 the methods of operation employ the mechanical advantage of leverage while utilizing a stanchion 16 to move the center of gravity over a base (pivot point). Post-operative patients may use the device 10 as a progressive tool for a continuum of rehabilitation from home to work. The continuum of rehabilitation starts with the patient using the assisted methods, then gradually progressing to the unassisted methods in the hospital, later to the nursing home, and then at the patient's home. To lift yourself to a standing position unassisted when sitting on the edge of a bed or chair, grasp the device 10 with your right hand on grip 12 and your left hand on grip 13. Located near the top of the device 10, these grips 12, 13 and 14 are adjustable by pushing down or twisting each grip 12, 13 and 14 to slide them up or down so that they can adjust to your personal height and individual comfort zone. When you do grasp the grips 12, 13 and 14, you will notice that they will not move. When pushing on a grip 12, the weight of the patient is driven down through the stanchion 16 into the anchor pad 15, wherein the device 10 relieves approximately ⅔ of the patient's weight. Place the anchor pad 15 about 6 inches in front of the bed or chair. Place the ball of one foot on the anchor pad 15 to temporarily anchor it to the ground and your other foot on the floor where comfortable. In one aspect, the handle 11 at the top of the device 10 is angled away from you approximately 20-degrees. Position and maintain your elbows slightly bent and at your sides and use your arms while lifting. Now, using the strength of your legs and arms with the help of the device 10, pull yourself up and forward, all in one motion (or you can push down on the grips and stand up). Straighten your legs and back as you rise. To lower yourself to a sitting position, reverse the same technique as described above, grasping hand grips 12 and 13 and letting yourself down slowly.

Alternatively, with just one grip 12, grasp the device 10 with your right hand on grip 12 and your left hand on the handle 11. A finger will rest on the lip 28 of the ring 20 to help determine if you have enough strength without the strap 36. Place the anchor pad 15 about 6 inches in front of the bed or chair. Place the ball of one foot on the anchor pad 15 to temporarily anchor it to the ground and your other foot on the floor where comfortable. In one aspect, the handle 11 at the top of the device 10 is angled away from you approximately 20-degrees. Position and maintain your elbows slightly bent and at your sides and use your arms while lifting. Now, using the strength of your legs and arms with the help of the device 10, pull yourself up and forward, all in one motion. Straighten your legs and back as you rise. To lower yourself to a sitting position, reverse the same technique as described above, grasping hand grips 12 and 13 and letting yourself down slowly.

To lift yourself to a sitting position in bed unassisted, first roll onto your left side to the edge of the bed. Place the anchor pad 15 on the floor, back toward the headboard. The handle 11 located at the top of the device 10 will be angled away from, toward your feet at about a 30-45 degree angle. Firmly hold hand grip 14 with your left hand while grasping handle 11 with your right hand. Now pull yourself up, using a pushing-out and away from you motion with your left hand, while pulling down and in toward yourself with your right hand. Alternatively, with just one grip 12, grasp the device 10 with your right hand on grip 12 and your left hand on the handle 11. A finger will rest on the lip 28 of the ring 20 to help determine if you have enough strength without the strap 36.

To lower yourself to a lying-down position while sitting up in bed, place the device 10 at a 45-degree angle. Let yourself down slowly while firmly holding hand grips 12 and 13. Alternatively, with just one grip 12, grasp the device 10 with your right hand on grip 12 and your left hand on the handle 11. A finger will rest on the lip 28 of the ring 20 to help determine if you have enough strength without the strap 36. If the patient cannot grip properly on the second time they will need to use the strap 36. The strap 36 may also be used for patients who have no arms—with the help of the adjustable strap 36, they can be lifted, lowered, and/or transferred by a caregiver. The strap 36 may also be used completely around a patient's waist. The strap 36 is slidably adjustable for the patient's waist size. One D ring (not shown) is secured to the main stanchion 16 about six inches from the bottom of the anchor pad 15. A second D ring (not shown) slides on the strap 36 and snaps with one of the two snap hooks (not shown). Both the D rings and hooks are non-magnetic metals. If the patient has had recent surgery the caregiver may use the strap 36 in the open position.

Depending on the individual, the caregiver will know and approve when the person is ready to use the device 10, as some individuals may feel faint or too weak to move by themselves. Each individual must be personally evaluated as to the support they need. If this is the first time the individual has tried to stand up, a second caregiver will be required to support the individual before using the device 10.

To lift an individual to a standing position assisted, have the individual sit on the edge of the bed or chair, then place the anchor pad 15 about 6 inches in front of the bed or chair. Have the individual place one or both feet on the top of the anchor pad 15. The individual grasps the device 10 with the right hand on grip 12 and left hand on grip 13. The individual will keep their arms bent and at their sides while being lifted. Make sure that the handle 11 located at the top of the device 10 is angled in front of the individual toward the caregiver approximately 20-degrees.

Next, the caregiver faces the individual and grasps handle 11 (one hand on top of the other) with arms straight out and elbows locked. It is to be understood that the caregiver could use only one hand, as well as using bent arms. The caregiver facing the individual places one foot about 18 inches from the anchor pad 15 and the other foot as far back as is comfortable. Now, all the caregiver has to do is lean back slowly for leverage, allowing their weight to do most of the work while the individual assists by leaning forward (slightly) and straightening their back as they rise up.

To sit a person up in bed assisted, the individual should be lying flat on their back. The device 10 is placed on the floor just to the top of the individual's hips and next to the bed with the handle 11 pointing toward the individual's feet at about a 20-degree angle. The individual should grasp hand grip 12 or 13 and hand grip 14 at this time. Next, the caregiver facing the patient places their right foot behind the anchor pad about 12 inches and close to the bed. The other foot should be placed about 18 inches further back. Lastly, the caregiver places two hands on handle 11 with their arms straight out and elbows locked, and pulls the device 10 parallel alongside the mattress toward the foot of the bed while sitting the individual up during the process. The individual should only use their arms to assist the caregiver.

To lower the individual onto the bed from a standing or sitting position, use the same techniques used to stand or sit the individual up, but this time start by leaning back and letting the device 10 down slowly, adjusting for the weight of the individual.

The instructions for descending and ascending stairs, are as follows: To use the device 10 when descending stairs, place one hand on the handrail. Firmly grasp hand grip 12 with the other hand. Place the anchor pad 15 onto the next step down from the one you are standing on. Now you are ready to descend to that step. With both feet on that step, place the anchor pad 15 down to the next step and repeat.

To use the device 10 while ascending stairs, place one hand on the handrail. Firmly grasp hand grip 12 with the other hand. The anchor pad 15 will be placed sideways on the step you are currently on. Now, step up to the next step with one foot then the other. When both feet are on that step, bring up and place the anchor pad 15 on that step. You are now ready to move up to the next step. As you ascend the stairs, always start by placing the anchor pad 15 on the step next to your feet. This will help protect you from falling backwards. Both feet will be together on the same step before proceeding to ascend to the next step.

The embodiments have been described, hereinabove. It will be apparent to those skilled in the art that the above methods and apparatuses may incorporate changes and modifications without departing from the general scope of the present teachings. It is intended to include all such modifications and alterations insofar as they come within the scope of the appended claims or the equivalents thereof. Although the description above contains much specificity, this should not be construed as limiting the scope of the present teachings, but as merely providing illustrations of some of the embodiments of the present teachings. Various other embodiments and ramifications are possible within its scope.

Furthermore, notwithstanding that the numerical ranges and parameters setting forth the broad scope of the present teachings are approximations, the numerical values set forth in the specific examples are reported as precisely as possible. Any numerical value, however, inherently contain certain errors necessarily resulting from the standard deviation found in their respective testing measurements.

Clause 1—A lifting device comprising an elongated member of substantially rigid material having a first end and a second end, wherein the elongated member is sufficiently resilient such that the elongated member may bend up to five degrees and still return to a vertical position, an interior reinforcing member located within the elongated member, a clear, anti-microbial coating covering the surface of the elongated member, at least one grip circumferentially attached to the elongated member, wherein the at least one grip is friction fit onto the elongated member, wherein the at least one grip has a first end, a second end, and a central portion, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly, wherein the grip has a non-smooth surface, patient grip safety ring located circumferentially about the first end of the central portion of the at least one grip, wherein the ring has an exterior lip that has a radius between 10 degrees and 45 degrees with respect to a perpendicular axis of the elongated member, a handle fixedly attached to the first end of the elongated member, and an anchor pad pivotably attached to the second end of the elongated member, wherein the anchor pad has a pivotable neck extending upwardly from the anchor pad, wherein the anchor pad has at least one beveled side angled downwardly away from the pivotable neck, wherein the anchor pad has a bottom side, wherein the bottom side of the anchor pad multiple indentations.

Clause 2—A lifting device comprising, an elongated member of substantially rigid material having a first end and a second end, wherein the elongated member is sufficiently resilient such that the elongated member may bend up to five degrees and still return to a vertical position, at least one grip circumferentially attached to the elongated member, wherein the at least one grip is friction fit onto the elongated member, wherein the at least one grip has a first end, a second end, and a central portion, patient grip safety ring located circumferentially about the first end of the central portion of the at least one grip, wherein the ring has an exterior lip that has a radius between 10 degrees and 45 degrees with respect to a perpendicular axis of the elongated member, and an anchor pad pivotably attached to the second end of the elongated member.

Clause 3—The device of clause 2, wherein the device further comprises a handle fixedly attached to the first end of the elongated member.

Clause 4—The device of clauses 2 or 3, wherein the device further comprises an interior reinforcing member located within the elongated member.

Clause 5—The device of clauses 2-4, wherein the device further comprises a clear, ant-microbial coating covering the surface of the elongated member.

Clause 6—The device of clauses 2-5, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly.

Clause 7—The device of clauses 2-6, wherein the grip has a non-smooth surface.

Clause 8—The device of clauses 2-7, wherein the anchor pad has a pivotable neck extending upwardly from the anchor pad.

Clause 9—The device of clauses 2-8, wherein the anchor pad has at least one beveled side angled downwardly away from the pivotable neck.

Clause 10—The device of clauses 2-9, wherein the anchor pad has a bottom side, wherein the bottom side of the anchor pad multiple indentations.

Clause 11—The device of clauses 2-10, wherein anti-microbial coating is silver infused.

Clause 12—The device of clauses 2-11, wherein the at least one grip and the handle are non-porous.

Clause 13—The device of clauses 2-12, wherein the anchor pad is quadrilateral, and each side of the quadrilateral has a beveled edge.

Clause 14—The device of clauses 2-13, wherein the beveled edge is angled at between 30 degrees and 60 degrees.

Clause 15—The device of clauses 2-14, wherein the bottom of the anchor pad has suction devices.

Clause 16—The device of clauses 2-15, wherein the elongated member is non-magnetic.

Clause 17—The device of clauses 2-16, wherein the device further comprises a strap, wherein the strap is attached to the elongated member, wherein the strap is non-magnetic.

What is claimed is:

1. A lifting device comprising:

an elongated member of substantially rigid material having a first end and a second end, wherein the elongated member is sufficiently resilient such that the elongated member may bend up to five degrees and still return to a vertical position;

an interior reinforcing member located within the elongated member;

a clear, anti-microbial coating covering a surface of the elongated member;

at least one grip circumferentially attached to the elongated member, wherein the at least one grip is friction fit onto the elongated member, wherein the at least one grip has a first end, a second end, and a central portion, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly, wherein the grip has a non-smooth surface;

a patient grip safety ring located circumferentially about the first end of the central portion of the at least one grip, wherein the ring has an exterior lip that has a radius between 10 degrees and 45 degrees with respect to a perpendicular axis of the elongated member;

a handle fixedly attached to the first end of the elongated member, and an anchor pad pivotably attached to the second end of the elongated member, wherein the anchor pad has a pivotable neck extending upwardly from the anchor pad, wherein the anchor pad has at least one beveled side angled downwardly away from the pivotable neck, wherein the anchor pad has a bottom side, wherein the bottom side of the anchor pad has multiple indentations.

2. A lifting device comprising:

an elongated member of substantially rigid material having a first end and a second end, wherein the elongated member is sufficiently resilient such that the elongated member may bend up to five degrees and still return to a vertical position;

a handle fixedly attached to the first end of the elongated member;

at least one grip circumferentially attached to the elongated member, wherein the at least one grip is friction fit onto the elongated member, wherein the at least one grip has a first end, a second end, and a central portion;

a patient grip safety ring located circumferentially about a first end of the central portion of the at least one grip, wherein the ring has an exterior lip that has a radius between 10 degrees and 45 degrees with respect to a perpendicular axis of the elongated member; and an anchor pad pivotably attached to the second end of the elongated member.

3. The device of claim 2, wherein the device further comprises an interior reinforcing member located within the elongated member.

4. The device of claim 3, wherein the device further comprises a clear, anti-microbial coating covering a surface of the elongated member.

5. The device of claim 4, wherein the central portion has a first end and a second end, wherein the circumference of the first end, the second end, and the central portion are substantially equal, wherein between the first end of the at least one grip and the first end of the central portion, the at least one grip tapers inwardly, wherein between the second end of the at least one grip and second end of the central portion, the at least one grip tapers inwardly.

6. The device of claim 5, wherein the grip has a non-smooth surface.

7. The device of claim 6, wherein the anchor pad has a pivotable neck extending upwardly from the anchor pad.

8. The device of claim 7, wherein the anchor pad has at least one beveled side angled downwardly away from the pivotable neck.

9. The device of claim 8, wherein the anchor pad has a bottom side, wherein the bottom side of the anchor pad has multiple indentations.

10. The device of claim 9, wherein the anti-microbial coating is silver infused.

11. The device of claim 10, wherein the at least one grip and the handle are non-porous.

12. The device of claim 11, wherein the anchor pad is quadrilateral, and each side of the quadrilateral has a beveled edge.

13. The device of claim 12, wherein the beveled edge is angled at between 30 degrees and 60 degrees.

14. The device of claim 13, wherein the bottom of the anchor pad further comprises suction devices.

15. The device of claim 2, wherein the elongated member is non-magnetic.

16. The device of claim 2, wherein the device further comprises a strap, wherein the strap is attached to the elongated member by fasteners, wherein the strap and fasteners are non-magnetic.

* * * * *